US009873143B2

(12) United States Patent
Arrington

(10) Patent No.: US 9,873,143 B2
(45) Date of Patent: Jan. 23, 2018

(54) PRODUCE BIN SCRUBBER AND RELATED METHODS

(71) Applicant: JOHN BEAN TECHNOLOGIES CORPORATION, Chicago, IL (US)

(72) Inventor: Clint P. Arrington, Lakeland, FL (US)

(73) Assignee: John Bean Technologies Corporation, Chicago, IL (US)

( * ) Notice: Subject to any disclaimer, the term of this patent is extended or adjusted under 35 U.S.C. 154(b) by 718 days.

(21) Appl. No.: 14/051,276

(22) Filed: Oct. 10, 2013

(65) Prior Publication Data

US 2014/0034083 A1 Feb. 6, 2014

Related U.S. Application Data

(60) Division of application No. 13/113,411, filed on May 23, 2011, now Pat. No. 8,566,994, which is a (Continued)

(51) Int. Cl.
*B08B 9/08* (2006.01)
*B08B 9/087* (2006.01)
(Continued)

(52) U.S. Cl.
CPC ..... *B08B 9/087* (2013.01); *B08B 9/0826* (2013.01); *B08B 9/30* (2013.01); *B08B 9/36* (2013.01)

(58) Field of Classification Search
CPC ..... B08B 9/0861
See application file for complete search history.

(56) References Cited

U.S. PATENT DOCUMENTS 1,710,682 A 4/1929 Brogden
1,883,772 A 10/1932 Engholm
(Continued)

FOREIGN PATENT DOCUMENTS

FR 2829714 3/2003
JP 6261636 9/1994
(Continued)

OTHER PUBLICATIONS

Fresh Cut, "Key Technology Acquires Freshline Machines", Mar. 2005, 1 pg.
(Continued)

*Primary Examiner* — Michael Kornakov
*Assistant Examiner* — Ryan Coleman
(74) *Attorney, Agent, or Firm* — Christensen O'Connor Johnson Kindness PLLC

(57) ABSTRACT

A produce bin washer for washing produce bins of an open-box type may include a housing and a conveyor for advancing a plurality of empty produce bins along a path of travel through the housing. The produce bin washer may include at least one scrubbing brush within the housing adjacent the conveyor and along the path of travel. The produce bin washer may also include a positioner within the housing for sequentially lifting and rotating each empty produce bin from the conveyor onto the at least one scrubbing brush to scrub the interior, and returning the empty produce bin to the conveyor. A sprayer may be within the housing for spraying a cleaning solution onto the empty produce bins, and a collector may also be within the housing for collecting sprayed cleaning solution.

17 Claims, 4 Drawing Sheets

Related U.S. Application Data continuation of application No. 12/122,343, filed on May 16, 2008, now Pat. No. 7,979,941.

(51) Int. Cl.
*B08B 9/30* (2006.01)
*B08B 9/36* (2006.01)

(56) References Cited

U.S. PATENT DOCUMENTS

| | | | | |
|---|---|---|---|---|
| 1,927,721 | A | 9/1933 | Stevens et al. | |
| 2,207,697 | A | 7/1940 | Kendall | |
| 2,889,566 | A | 6/1959 | Parks | |
| 2,956,297 | A | 10/1960 | Edmunds | |
| 3,018,200 | A | 1/1962 | Huddle | |
| 3,040,351 | A | 6/1962 | Parks | |
| 3,479,678 | A | 11/1969 | Jeffreys | |
| 3,604,038 | A * | 9/1971 | Di Ilio | B65F 7/005 134/152 |
| 3,733,849 | A | 5/1973 | Cantagallo et al. | |
| 4,126,910 | A | 11/1978 | Beer | |
| 4,160,457 | A | 6/1979 | Dickson, Jr. et al. | |
| 4,192,034 | A | 3/1980 | Knepper, Jr. | |
| 4,403,364 | A | 9/1983 | Schroeder | |
| 4,635,312 | A | 1/1987 | Byers | |
| 4,805,649 | A | 2/1989 | Nezworski | |
| 5,371,911 | A | 12/1994 | Mullinax | |
| 5,425,385 | A | 6/1995 | Kuta et al. | |
| 5,746,233 | A | 5/1998 | Kuroda et al. | |
| 5,783,790 | A * | 7/1998 | Mitsumori | B08B 3/12 134/1 |
| 5,809,739 | A * | 9/1998 | Eno | B65B 55/10 422/24 |
| 5,957,044 | A | 9/1999 | Kravitz | |
| 6,336,239 | B1 | 1/2002 | Cooper | |
| 6,368,183 | B1 | 4/2002 | Trojan et al. | |
| 2003/0070691 | A1 * | 4/2003 | Giletto | A01N 37/16 134/3 |
| 2005/0061623 | A1 | 3/2005 | Schloesser | |
| 2008/0035176 | A1 * | 2/2008 | Byers | B08B 9/0826 134/22.1 |
| 2008/0089764 | A1 | 4/2008 | Vistro | |

FOREIGN PATENT DOCUMENTS

| | | |
|---|---|---|
| JP | 1043703 | 2/1998 |
| JP | 11347507 | 12/1999 |
| JP | 2003144370 | 5/2003 |
| WO | 9952655 | 10/1999 |

OTHER PUBLICATIONS

Durand-Wayland, Inc., "Crate & Bin Handling", 1934, pp. 1-7.
Salazar Machine & Steel, Inc., "Washer Systems", downloaded from http:/www.salazarmachine.com/bin.html, Apr. 2008, pp. 1-2.
Salazar Machine & Steel, Inc., "Crate Washer Line", downloaded from http:/www.salazarmachine.com/cws.html, Apr. 2008, pp. 1-2.
Salazar Machine & Steel, Inc., "Bin Washer GCS © 700 Systems", downloaded from http:/www.salazarmachine.com/gcs.html, Apr. 2008, pp. 1-2.

* cited by examiner

PRODUCE BIN SCRUBBER AND RELATED METHODS

FIELD OF THE INVENTION

The present invention relates to the field of cleaning, and more particularly, to the field of cleaning produce bins.

BACKGROUND OF THE INVENTION

Fresh produce is typically transported from a field to a packing facility in a bin. Each bin may vary in size and is typically constructed of plastic or wood, for example. Each bin is reused several times in a given season, and may be used for harvesting different kinds of produce throughout a calendar year. With each use, each bin accumulates a buildup of organic debris, which may include dirt and caked on mud, leaves, twigs, and fruit and/or vegetable particles. The remaining debris may tend to harbor and promote the growth of bacteria and various pathogens that are potentially harmful to the produce. Moreover, government regulations may require that each bin be sanitized before reuse to avoid contamination of produce. After use, each bin is placed on a trailer for transport to the next field harvest location for reuse in transporting the produce to the packing facility.

At the packing facility, each produce bin is typically placed on a conveyer that will convey the bin and its contents to a dump mechanism. The dump mechanism will invert the produce bin to a degree that with contents of the bin will be removed from the bin. The produce that is dumped from the bin may leave organic debris, such as leaves and twigs, in the bin. The process of placing produce in the bin during the field harvest may cause dirt and/or mud to accumulate on the exterior and interior of the bin. Additionally, placing the bin on the ground during the field harvest may result in the bin collecting dirt and/or debris, as well as potentially produce pathogens. Pathogens may reside in the soil, and, indeed, grove owners will typically trim lower branches to avoid contact with the soil. Some current methods of unpacking the produce either do not remove the organic debris from the bin, or the organic debris is manually removed at a remote location by manual labor and the use of a hand held pressurized washer system. The manual removal of the organic debris is time consuming, expensive to the packing facility, and inefficient in removing the debris.

Prior art attempts, such as those provided by Salazar Machine and Steel, Inc. of Immokalee, Fla., and Durand-Wayland, Inc. of LaGrange, Ga., have automated the debris removal methods. Salazar Machine and Steel, Inc.'s Crate Washer line includes a system that places each crate onto a conveyor belt. The conveyor belt moves the crate into the system where it is washed and sanitized with chemicals via pressurized spray nozzles.

Similarly, a Durand-Wayland, Inc. bin washer system includes a multi-stage system where a bin enters the system in an upright position. A carousel rotates the bin a quarter turn so that it is positioned on its side, which allows a second bin to enter the system. A new bin enters the system and exits the system with each quarter turn. A high-pressure spray system provides cleaning to each bin in the system at each position. A similar Durand-Wayland, Inc. system is a liner floor system that continuously moves a single bin through a high-pressure spray to clean each bin.

However, the prior art attempts use only a pressurized spray solution to attempt to clean each produce bin. The use of a spray solution will likely remove a portion of the organic debris, but may not remove the debris that may be lodged in the bin openings or the debris that has adhered to the bin surface. Still, further improvements are needed to remove organic debris from a produce bin.

SUMMARY OF THE INVENTION

In view of the foregoing background, it is therefore an object of the present invention to provide an efficient apparatus for removing debris from produce bins.

This and other objects, features, and advantages in accordance with the present invention are provided by a produce bin washer for washing produce bins of an open-box type having an interior and an exterior. The produce bin washer may include a housing having an inlet and an outlet. The produce bin washer may also include a conveyor for advancing a plurality of empty produce bins along a path of travel through the housing from the inlet to the outlet thereof. At least one scrubbing brush may be provided within the housing adjacent the conveyor and along the path of travel. The produce bin washer may also include a positioner within the housing for sequentially lifting and rotating each empty produce bin from the conveyor onto the at least one scrubbing brush to scrub the interior, and returning the empty produce bin to the conveyor. A sprayer may be included within the housing for spraying a cleaning solution, e.g., water alone or including a detergent, onto the exterior of the empty produce bins at least when positioned onto the at least one scrubbing brush. A collector may be within the housing for collecting sprayed cleaning solution, for example. Accordingly, the produce bin washer may provide more thorough debris removal from a produce bin than debris removal from a solution sprayer alone.

The at least one scrubbing brush may include a core and a plurality of groups of bristles extending outwardly from the core. Additionally, the core may include a rotatable base and an end cap opposite the rotatable base. A plurality of longitudinal struts may connect the base and the end cap together. At least one of the plurality of groups of bristles may be carried by the end cap, and at least one other of the plurality of groups of bristles may be carried by the plurality of longitudinal struts. Still further, the core may define an axis, and the positioner may position the empty produce bin onto the at least one scrubbing brush so that the axis of the core extends normal to a bottom of the empty produce bin.

The produce bin washer may further include an electric motor coupled to the at least one scrubbing brush. A controller may be coupled to the electric motor for rotating the at least one scrubbing brush in alternating directions. Accordingly, more thorough cleaning may be provided.

The positioner may include a pivotably mounted carriage for temporarily holding the empty produce bin. Additionally, at least one actuator may be included for pivoting the pivotably mounted carriage.

The produce bin washer may further include a filter downstream from the collector, and a solution holding tank downstream from the filter. A pump for delivering cleaning solution from the holding tank to the sprayer may also be included. A sanitizer sprayer may be downstream from the housing along the path of travel, and at least one cleaning solution sensor may be associated with the cleaning solution, for example.

A method aspect is directed to washing produce bins of an open-box type having an interior and an exterior. The method may include advancing, via a conveyor, a plurality of empty produce bins along a path of travel through a housing. The method may further include sequentially lifting and rotating each empty produce bin from the conveyor onto at least one scrubbing brush, scrubbing the interior of the produce bin with the at least one scrubbing brush, and returning the empty produce bin to the conveyor. The method may further include spraying a cleaning solution onto the empty produce bins at least when positioned onto the at least one scrubbing brush. The method may also include collecting sprayed cleaning solution.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
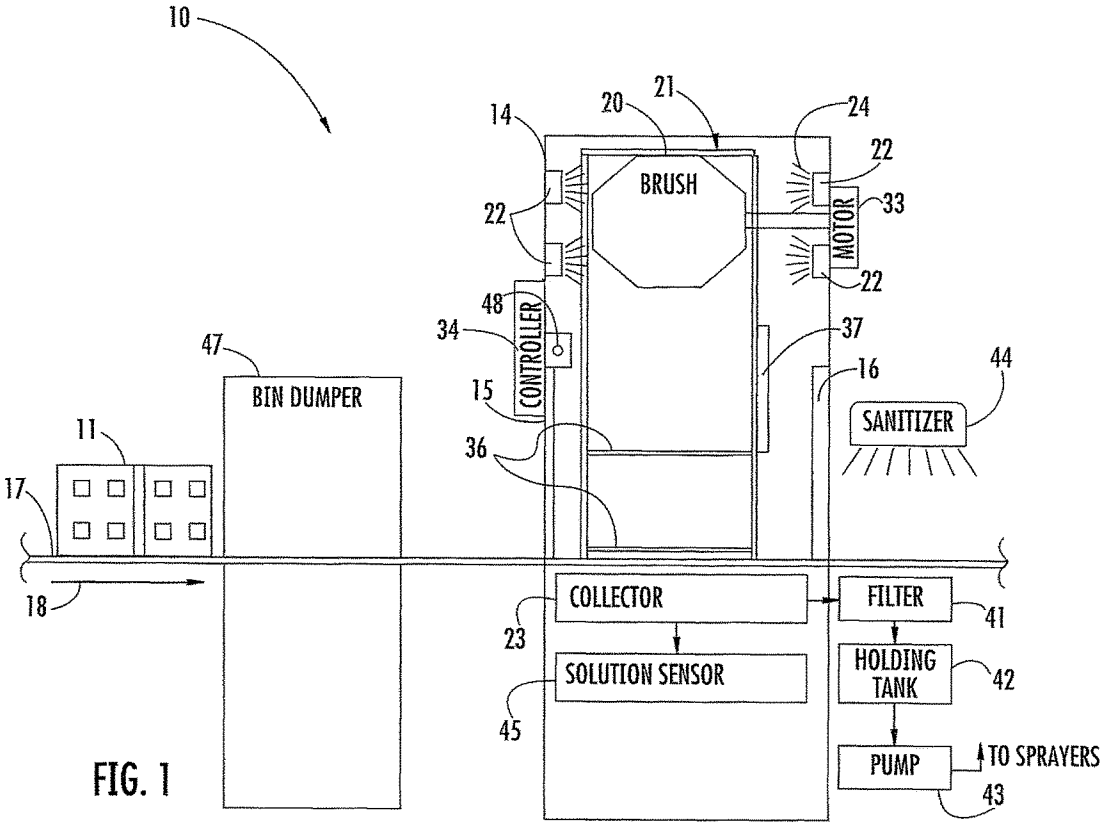
FIG. 1 is a schematic block diagram of a produce bin scrubber in accordance with the present invention.

Referring initially to FIG. 1, a produce bin washer 10 is for washing produce bins 11 of an open-box type having an interior and an exterior. The produce bins 11 also typically include openings in the sidewalls and/or bottom. The produce bin washer 10 includes a housing 14 having an inlet 15 and an outlet 16. The produce bin washer 10 illustratively includes a conveyor 17 for advancing a plurality of empty produce bins 11 along a path of travel 18 through the housing 14 from the inlet 15 to the outlet thereof 16. A scrubbing brush 20 is within the housing 14 adjacent the conveyor 17 and along the path of travel 18. A positioner 21 is illustratively provided within the housing 14 for sequentially lifting and rotating each empty produce bin 11 from the conveyor 17 onto the scrubbing brush 20 to scrub the interior, and returning the empty produce bin to the conveyor.

A produce bin 11, which may be filled with produce, is advanced by the conveyor 17 to an optional produce bin dumper 47. The produce bin dumper 47 removes each produce bin 11 from the conveyor 17, lifts each produce bin, and rotates each produce bin to a degree of elevation that allows produce within the produce bin to be removed and placed in produce processing equipment (not shown). The empty produce bin 11 is replaced on the conveyor 17 where it is advanced along the path of travel 18. The produce bin dumper 47 may not be used in some embodiments.

Figure 2:
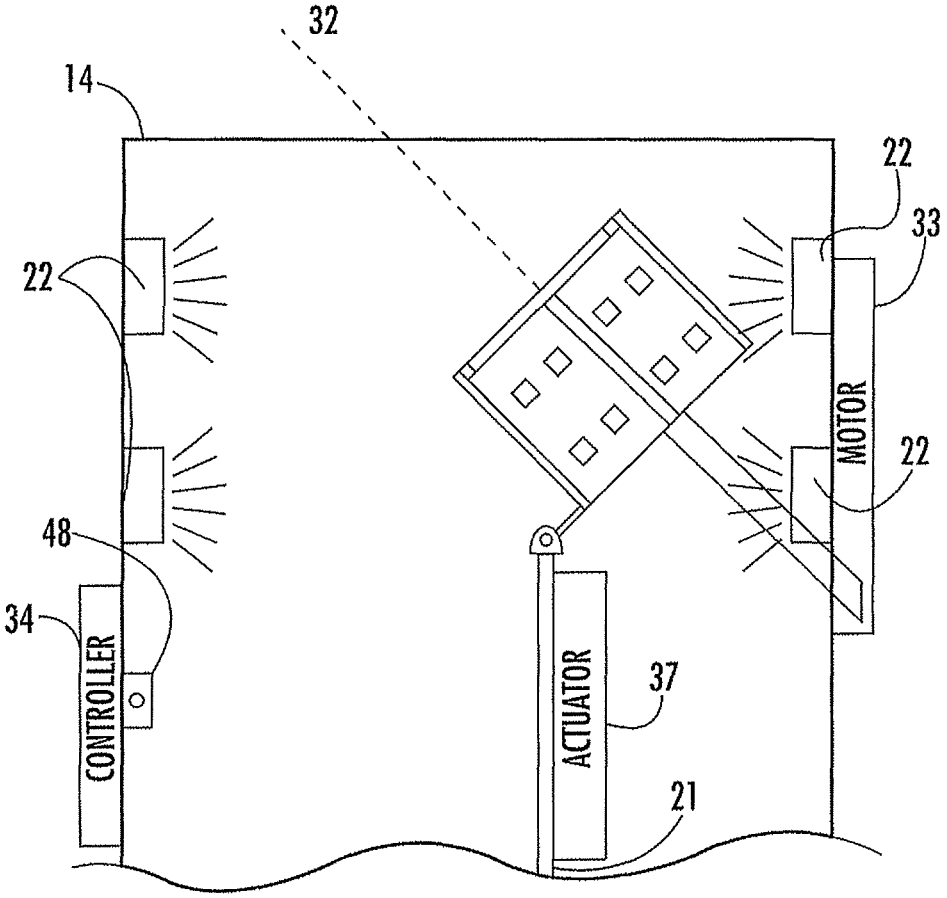
FIG. 2 is a side plan view of the portion of the produce bin scrubber of FIG. 1.

Referring now additionally to FIG. 2, the empty produce bin 11 is advanced along the path of travel 18 into the housing inlet 15 via the conveyor 17. Once inside the housing 14, the positioner 21 sequentially removes each produce bin 11 from the conveyor 17 via a pivotably mounted carriage 36 for temporarily holding the empty produce bin 11.

A sensor 48 is illustratively coupled to the bin scrubber carriage 36 for determining when a produce bin 11 is advanced by the conveyor 17 into the housing inlet 15, and based thereon activates the positioner 21 to remove the produce bin 11. The sensor 48 may include a mechanical limit switch, an optical sensor, or a proximity sensor, for example. Once removed from the conveyor 17, the produce bin 11 and carriage 36 are pivoted by the actuator 37 so that the produce bin is lifted and rotated about 135 degrees, for example, onto the scrubbing brush 20 to scrub the interior of the produce bin. The produce bin 11 and carriage 36 may be pivoted by the actuator 37 so that the produce bin is lifted and rotated at an angle greater than 90 degrees, as will be appreciated by those skilled in the art. As illustrated perhaps best in FIG. 2, the interior of the produce bin 11 is in contact with the scrubbing brush 20.

Figure 3:
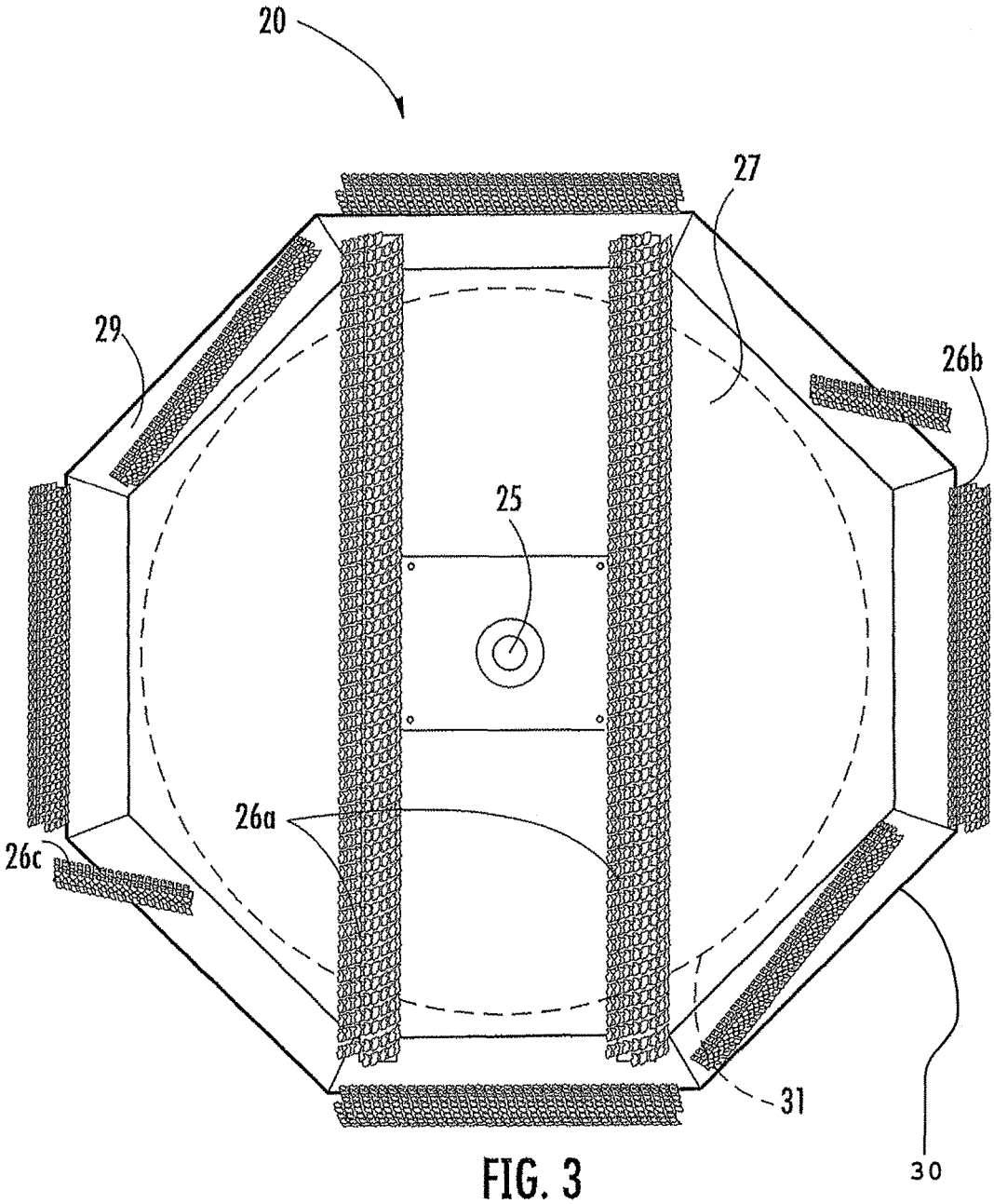
FIG. 3 is a top perspective view of a scrubbing brush as used in the produce bin scrubber of FIG. 1.
Figure 4:
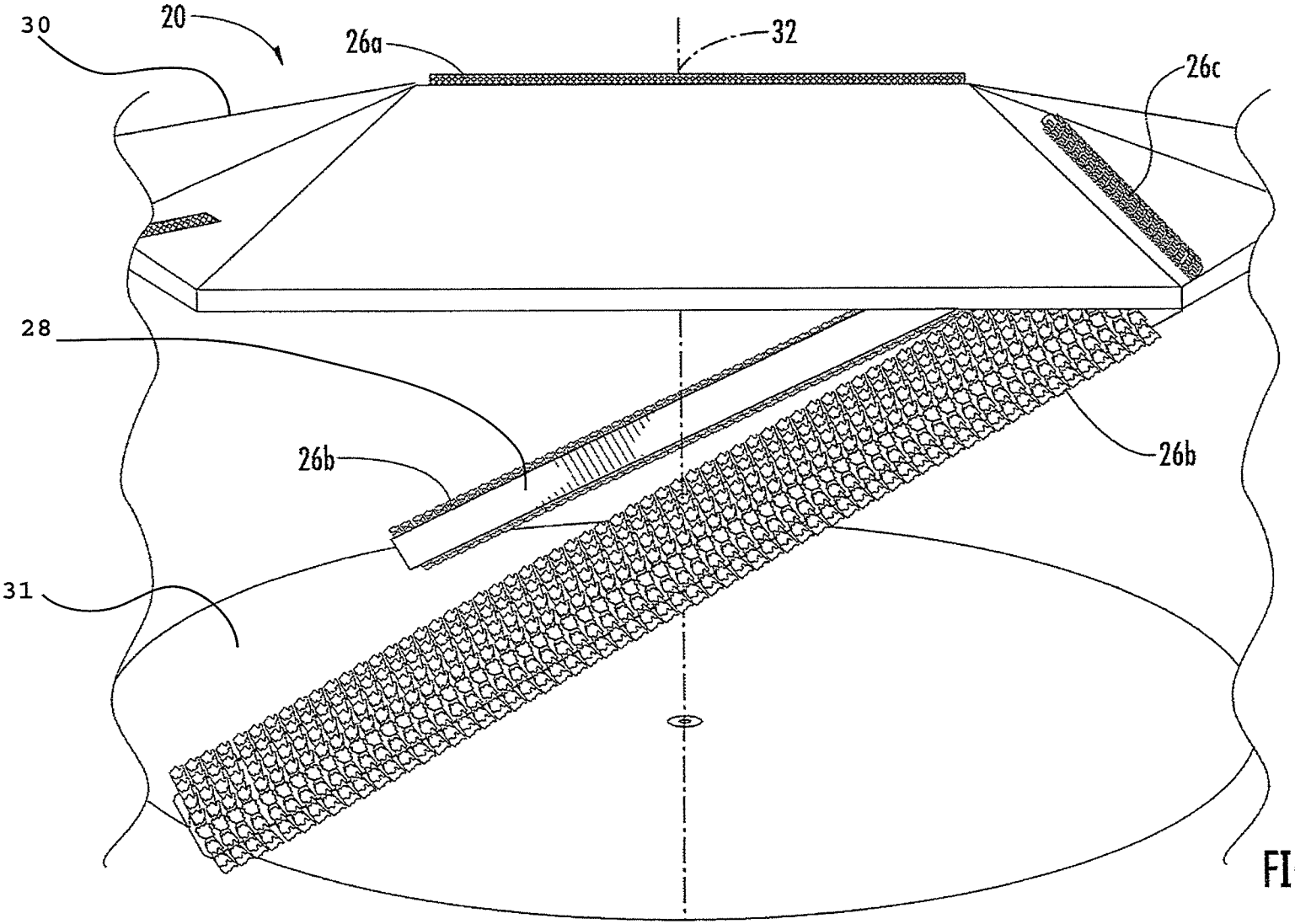
FIG. 4 is a side perspective view a portion of a scrubbing brush as shown in FIG. 3.

Turning now additionally to FIGS. 3 and 4, the scrubbing brush 20 illustratively includes a core 25 and a plurality of groups of bristles 26*a*-26*c* extending outwardly from the core. The core 25 includes a rotatable base 31 that is circular in shape, and an end cap 30 that is opposite the rotatable base and illustratively octagonal in shape. Other base 31 and end cap 30 shapes may be used, for example. The end cap 30 illustratively includes a flat octagonal shaped portion 27 with a group of two parallel spaced apart elongated groups of bristles 26*a* thereon for cleaning a bottom of the produce bin 11 and reaching into the difficult to clean corners. An angled portion 29 is coupled to the flat octagonal shaped portion 27. The angled portion 29 illustratively includes another group of bristles 26*c* and is advantageously angled away from the bottom of the produce bin 11 to allow scrubbed debris to fall away from or out of the produce bin.

Longitudinal struts 28 connect the base 31 and the end cap 30 together. The longitudinal struts 28 are connected to the end cap 30 at the angled portion 29 and to the rotatable base 31 at a mounting bracket (not shown). Another group of bristles 26*b* is coupled to the each of the plurality of longitudinal struts 28. As illustrated in FIG. 4, for example, the area behind each longitudinal strut 28 and between the base 31 and the end cap 30 may be open. In other words, there is no solid face between the base 31 and the end cap 30. This coupling arrangement of each longitudinal strut 28 and the bristles 26*b* thereon to the base 31 and the end cap 30 advantageously reduces weight and increases the cleaning effectiveness of the brush 20 by allowing scrubbed falling debris to fall through the brush and not get caught up in it, or other groups of bristles 26*a*-26*c* extending outwardly therefrom.

The groups of bristles 26*b*-26*c* on the longitudinal struts 28 and angled portion 29 illustratively extend outward in a diagonal direction. The diagonal direction advantageously allows for a more thorough cleaning action, including into corners of the produce bin 11, and further advantageously allows debris to be directed toward the inverted open top of the produce bin during scrubbing.

The core 25 defines an axis 32, and the positioner 21 positions the empty produce bin 11 onto the at least one scrubbing brush 20 so that the axis of the core extends normal to a bottom of the empty produce bin. The scrubbing brush 20 advantageously provides increased debris removal, for example, from the corners and crevices in each produce bin 11 where spraying alone will not remove the debris. The increased debris removal provided by the scrubbing brush 20 also advantageously reduces the bacteria and pathogens carried by the each produce bin 11, thus, reducing the likelihood of transfer of produce destroying diseases, such as citrus canker, for example.

Referring again to FIGS. 1-2, the produce bin washer 10 includes an electric motor 33 coupled to the scrubbing brush 20. A controller 34 is coupled to the electric motor 33 for controlling rotation of the scrubbing brush 20 in one direction. After controlling the rotation of the scrubbing brush 20 in one direction for a set time period, the controller 34 controls the rotation of the scrubbing brush 20 in an alternate direction. Providing rotation in alternate directions advantageously provides more thorough cleaning, as will be appreciated by those skilled in the art.

Sprayers 22 are within the housing 14 for spraying a cleaning solution 24 onto the empty produce bins 11 at least when positioned onto the scrubbing brush 20. The cleaning solution 24 may be water alone or including one or more detergents, for example. The sprayers 22 may be low-pressure, high-volume sprayers, for example, to facilitate debris removal from both the interior and exterior of each produce bin 11. Also, the sprayers 22 may be high-pressure sprayers and may be coupled to an additional filter for accommodating the high-pressure sprayers, as will be appreciated by those skilled in the art. Still further, the sprayers 22 may selectively spray the cleaning solution 24 continuously when the produce bin 11 is within the housing 14, or just when the produce bin 11 is on the scrubbing brush 20. Alternatively, the sprayers 22 may continuously spray regardless of whether a produce bin 11 is in the housing 14 or not. Other spraying arrangements will be appreciated by those skilled in the art.

A cleaning solution sensor 45 is associated with the cleaning solution 24. The cleaning solution sensor 45 cooperates with the controller 34 to maintain the cleaning solution 24 at a desired pH level, for example. Similarly, the controller 34 may control the oxidation reduction potential (ORP) for maintaining the cleaning solution 24 at a desired ORP level. The controller 34 may also cooperate with the cleaning solution sensor 45 to control other cleaning solution parameters, as will be appreciated by those skilled in the art.

Illustratively, the sprayed cleaning solution 24 is advantageously contained by the housing 14. The cleaning solution 24 drips toward a collector 23, which is within the housing 14 for collecting sprayed cleaning solution 24. The collector may be a drip pan assembly, for example, or other collector, and may also direct sprayed cleaning solution 24 downstream to a filter 41. The filter 41, in turn, is illustratively located downstream from the collector 23, and may advantageously filter solid debris collected from the produce bins 11. A solution holding tank 42 is also downstream from the filter 41 for holding filtered spray solution 24. A pump 43 is coupled to the solution holding tank 42 and delivers the cleaning solution 24 from the holding tank to the sprayers 22. Thus, the cleaning solution 24 is advantageously recycled. Makeup solution may also be added as will be appreciated by those skilled in the art.

After completing a scrubbing and spraying cycle, the produce bin 11 is returned to the conveyor 17. The produce bin 11 continues along the path of travel 18 via the conveyor 17 through the outlet 16 of the housing 14 to an optional sanitizer sprayer 44 downstream from the housing. The sanitizer sprayer 44 may advantageously spray a sanitizing agent to the interior and exterior of each produce bin 11. This may advantageously further reduce the bacteria and pathogens on each produce bin 11, and, thus, reduce cross contamination among facilities.

A method aspect is directed to washing produce bins 11 of an open-box type having an interior and an exterior. The method includes advancing, via a conveyor 17, a plurality of empty produce bins 11 along a path of travel 18 through a housing 14. The method further includes sequentially lifting and rotating each empty produce bin 11 from the conveyor 17 onto scrubbing brush 20, and scrubbing the interior of the produce bin with the at least one scrubbing brush, and returning the empty produce bin to the conveyor. The method further includes spraying a cleaning solution 24 onto the empty produce bins 11 at least when positioned onto the scrubbing brush 20, and collecting the sprayed cleaning solution 24.

In other embodiments, a brush may be moved in and out of the produce bin while it remains on the conveyor. In these embodiments a vacuum may be used to first remove debris from the produce bin as will be appreciated by those skilled in the art. Indeed, many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. An automated method for washing produce bins of an open-box type having an interior defined by a base and sides, the method comprising:

operating a positioner for relatively positioning a produce bin with at least one brush assembly, the at least one brush assembly comprising a core defining a rotational axis of the brush assembly, said core comprising spaced-apart first and second end members and struts connecting the first and second end members to define an open space between the first and second end members, the second end member positionable adjacent the base of the produce bin, and a plurality of individual, longitudinal brushes mounted on the brush assembly, each longitudinal brush comprising bristles projecting from the longitudinal brush, and wherein at least one of the longitudinal brushes is mounted on and extends across the second dish-shaped end member to be presented to the base of the produce bin;

rotating the at least one brush assembly about an axis of the core so that the brushes of the brush assembly contact the interior of the produce bin;

supporting the at least one brush assembly during rotation thereof so that the bristles of the longitudinal brushes are able to reach substantially the entirety of the interior of the produce bin; and spraying a liquid toward the produce bin from a sprayer at least when the interior of the produce bin is in contact with the brushes of the at least one brush assembly.

2. The method according to claim 1 wherein the positioner comprises:

a pivotably mounted carriage for temporarily holding the produce bin; and at least one actuator for pivoting the pivotably mounted carriage.

3. The method according to claim 1 further comprising operating a conveyor for advancing a plurality of produce bins along a path of travel; and wherein the positioner lifts and rotates each produce bin from the conveyor and returns each produce bin back to the conveyor.

4. The method according to claim 1 further comprising using a collector for collecting sprayed liquid.

5. The method according to claim 1 further comprising operating a sanitizer sprayer downstream from the positioner.

6. An automated method for washing produce bins of an open-box type, the method comprising:

operating a conveyor to advance a plurality of produce bins along a path of travel;

operating a positioner so that a produce bin and at least one brush assembly are relatively positioned so that the produce bin is in contact with the at least one brush assembly, the at least one brush assembly comprising a core structure defining a rotational axis of the brush assembly, and a plurality of elongate brushes disposed at orientations that are non-parallel and also not perpendicular to each other, said elongate brushes comprising bristles projecting from the elongate brushes;

said core structure comprising a base member and a cap member spaced from the base member by a plurality of struts to define an open space between the base member and the cap member, the elongate brushes mounted on the struts and on the cap member so that the bristles of the elongate brushes project from the elongate brushes;

rotating the brush assembly about the rotational axis of the core structure, wherein the rotational axis is not parallel and also not perpendicular to the lengths of at least some of the brushes; and spraying a liquid toward the produce bin from a sprayer.

7. The method according to claim 6 wherein the positioner lifts and rotates each produce bin from the conveyor and returns each produce bin back to the conveyor.

8. The method according to claim 6 wherein a plurality of groups of brushes extend outwardly from the core structure.

9. The method according to claim 6 further comprising using a collector for collecting sprayed liquid.

10. The method according to claim 9 further comprising using a pump to deliver liquid from a liquid holding tank to the sprayer, the liquid holding tank being downstream from a filter, and the filter being downstream from the collector.

11. The method according to claim 6 further comprising operating a sanitizer sprayer downstream from the positioner.

12. The method according to claim 6 further comprising sensing, using at least one liquid sensor associated with the liquid, at least one chemical property of the liquid.

13. The method according to claim 12 wherein using the at least one liquid sensor comprises using the at least one liquid sensor for sensing a pH of the liquid.

14. The method according to claim 12 wherein using the at least one liquid sensor comprises using the at least one liquid sensor for sensing an oxidation reduction potential (ORP) of the liquid.

15. The method according to claim 1, wherein at least some of the brushes of the brush assembly are disposed at an angle relative to the rotational axis of the brush assembly that is neither parallel nor perpendicular to the rotational axis of the brush assembly.

16. The method of claim 1, further comprising vacuuming the interior of the produce bin.

17. The method of claim 1, further comprising rotating the at least one brush assembly in a first direction about the axis of the core and then rotating the brush assembly in the opposite direction about the axis of the core.

* * * * *